US006411025B1

(12) United States Patent
Bae

(10) Patent No.: US 6,411,025 B1
(45) Date of Patent: Jun. 25, 2002

(54) COLOR CATHODE RAY TUBE

(75) Inventor: Hyo Dae Bae, Daegu (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/499,294

(22) Filed: Feb. 7, 2000

(30) Foreign Application Priority Data

Feb. 8, 1999 (KR) ..... 99/4171

(51) Int. Cl.[7] ..... H01J 29/80
(52) U.S. Cl. ..... 313/408; 313/403; 313/461
(58) Field of Search ..... 313/403, 408, 313/461

(56) References Cited

U.S. PATENT DOCUMENTS 3,988,777 A * 10/1976 Hosokoshi et al. ..... 358/65

* cited by examiner

*Primary Examiner*—Sandra O'Shea
*Assistant Examiner*—Ali Alavi

(74) *Attorney, Agent, or Firm*—Fleshner & Kim, LLP

(57) ABSTRACT

A color cathode ray tube is provided having a shadow mask or screen designed to an optimum state or whose panel's light absorption coefficient is set to an optimum value even if the panel has a high wedge ratio, thereby obtaining excellent bright uniformity characteristics. The color cathode ray tube includes a panel with a wedge ratio of more than 170%; a screen onto which electronic beams are scanned and on which fluorescent dots coated with RGB fluorescent materials and a black matrix layer filled with a black coating material throughout all the regions except for the fluorescent dots are formed; and a shadow mask on which a plurality of slots are arranged corresponding to the fluorescent dots, wherein the dot diameter at the corner portion of a screen is larger than that at the center portion by about 100–127%, the slot width at the corner portion of a shadow mask is larger than that at the center portion by about 105–133%. Accordingly, even though the wedge ratio is more than 170%, more than 50% bright uniformity (BU) characteristics are assured, and a tint glass can be used in fabricating a panel, thereby reducing the fabrication cost and weight of the color cathode ray tube.

9 Claims, 6 Drawing Sheets

COLOR CATHODE RAY TUBE

BACKGROUND OF THE INVENTION

1. Field of the Invention

The present invention relates to a color cathode ray tube and, more particularly to a color cathode ray tube having a panel with a high wedge ratio, wherein a shadow mask or a screen is designed to an optimum state, or the light absorption coefficient of the panel is set to an optimum value, thereby having improved bright uniformity (BU) characteristics.

2. Description of the Conventional Art

Generally, a color cathode ray tube is a display widely used in a television receiver, or the monitors of oscilloscope for measurement and RADAR for observation. The color cathode ray tube displays an image on a display through Red, Green and Blue fluorescent materials which are excited by the electron beams from the electron guns (or cathodes).

FIG. 1 is a cross-sectional view of a shadow mask-type color cathode ray tube, wherein a rectangular shape panel 1, a funnel 2 connected to the panel 1, a cylindrical glass neck 3 connected to a smaller-diameter end of the funnel 2, and an in-line electron gun 4 within the neck 3 are illustrated.

A screen 5 coated with a fluorescent material is installed on an inner surface of the panel 1, a shadow mask 6 for selecting color on the screen 5 is installed at a predetermined distance from the screen 5, and a deflection yoke 7 which generates a pin cushion type horizontal deflection magnetic field and a barrel type vertical deflection magnetic field is mounted on outer surfaces of the neck 3 of the funnel 2.

FIG. 2 is a detailed view of the screen 5. The screen includes fluorescent dots 5*a* coated with red, green, and blue(RGB) fluorescent materials on an inner effective surface of the panel 1 and a black matrix layer 5*b* filled with a black coating material on the regions except for the fluorescent dots 5*a*. Herein, the RGB fluorescent materials are divided into a dot type and a stripe type according to the shape of the fluorescent materials formed on the screen.

FIG. 3 is a detailed view of the shadow mask 6. The shadow mask includes a plurality of slots (or holes) 6*a* corresponding to the fluorescent dots 5*a*, in order that electron beams emitted from the electronic gun may pass through the shadow mask 6 and be incident upon the fluorescent dots 5*a*, and the slots are coated with a spray after blackening.

When electron beams 8 are emitted from the electron guns 4, the electron beams 8 are deflected by horizontal and vertical deflection fields of the deflection yoke 7 in order to scan the entire screen, and then the deflected beams 8 converge on the plurality of slots 6*a* formed on the shadow mask 6.

When the electron beams 8 having passed through each of the slots 6*a* are emitted on the screen 5, the RGB fluorescent materials 5*c* are illuminated to thereby reproduce a color image on the panel 1.

Currently, the outer surface of a panel 1 is being made flat. That is, the panel of a color cathode ray tube having curvatures of both inner and outer surfaces as shown in FIG. 4A is being changed to a panel of a color cathode ray tube having a curved inner surface and a flat outer surface, respectively as shown in FIG. 5A. The wedge ratio of the thickness of a central panel to a corner panel is usually from 150% to 250%.

However, when only the outer surface of a panel is flat as shown in FIG. 5A under the condition that both inner and outer surfaces of the panel have curvatures as shown in FIG. 4B, the uniformity of the brightness, i.e., the BU characteristics (which is one of the most important screen characteristics) decreases. A comparison between FIG. 4B and FIG. 5B shows when the outer surface of the panel is flat, the brightness characteristics has a Gauss distribution.

Hence, in order to prevent deterioration of the uniformity of the brightness, a panel with improved transmittance is fabricated by using a clear glass with a smaller light absorption coefficient and by determining the transmittances of a shadow mask and a screen by a simulation experiment design even though there is another method of improving the transmittance of the panel. Generally, the absorption coefficient of a panel is more than 0.01298.

The transmittance of a shadow mask depends on the slot area (referring to the slot width as the same meaning of the slot area), for example, the slot width at the corner portion can be 200 $\mu$m and the slot width at the center portion can be 180 $\mu$m. Similarly, the screen's transmittance depends on the dot (or stripe) areas forming on the screen, which will be referred to the width of the dot as below, for example, the dot width at the corner portion can be 160 $\mu$m and the dot width at the center portion can be 150 $\mu$m.

In order to prevent deterioration of the BU characteristics of a flat outer surface panel, the slot widths at the corner portion and at the center portion of a shadow mask and the dot diameters at the corner portion and at the center portion of a screen are determined by the above values, and the panel is fabricated from a clear glass with a smaller light absorption coefficient by means of a simulation experiment design, thereby obtaining a predetermined light absorption coefficient and transmittances of a shadow mask and screen. However, there is a problem that the BU of the panel cannot be obtained if the wedge ratio of a panel is more than 170%, and furthermore the weight and cost of the color cathode ray tube increase because of using clear glass.

SUMMARY OF THE INVENTION

It is an object of the present invention to provide a cathode ray tube having improved bright uniformity characteristics by optimally setting the light absorption coefficient of a panel or designing the slot widths of a shadow mask or the dot diameters of a screen to an optimum state even though the panel's wedge ratio is more than 170%.

To this end, there is provided a color cathode ray tube including a panel with a wedge ratio of more than 170%; a screen onto which electronic beams are stroked and on which fluorescent dots coated with RGB fluorescent materials and a black matrix layer filled with a black coating material throughout all the regions except for the fluorescent dots are formed; and a shadow mask on which a plurality of slots are arranged corresponding to the fluorescent dots, wherein the dot diameter at the corner portion of a screen is larger than that at the center portion by about 100~127%, and the slot width at the corner portion of a shadow mask is larger than that at the center portion by about 105~133%,

DETAILED DESCRIPTION OF THE PREFERRED EMBODIMENTS

Figure 1:
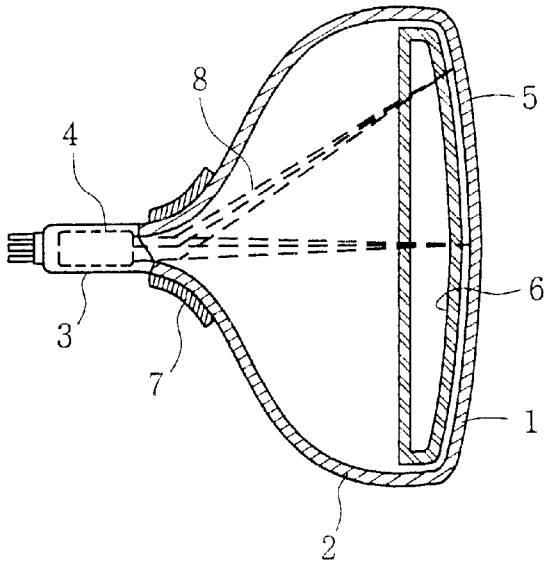
FIG. 1 CONVENTIONAL ART
FIG. 1 is a cross-sectional view showing a conventional color cathode ray tube.

The present invention relates to a color cathode ray tube with improved BU characteristics, for example 50%, even if the wedge ratio of a panel is more than 170%. First, the factors affecting the brightness can be deducted from the following equation (1) as a bightness (B) as below:

$$B = n \times Tp \times Ts \times Ta \times Tm \times \frac{Ik \times V}{\pi \times S} \times \left(1 - \frac{Tr}{T}\right) \times 0.2919 \quad (1)$$

Wherein, n denotes luminance of a fluorescent material, Tp denotes panel transmittance (it can change according to the light absorption coefficient based on a glass ingredient), Ts denotes screen transmittance (=the dot diameter/the electron beam diameter), Ta denotes screen transmittance after aluminum evaporation, Tm denotes shadow mask transmittance, Ik denotes cathode current, V denotes anode voltage, π denotes 3.14, S denotes effective luminous area, and $$1 - \frac{Tr}{T}$$

denotes retrace time ratio. In addition, Tr denotes flyback time and T denotes the total scan time of a frame.

The following three methods for improving the BU characteristics of a color cathode ray tube can be determined according to change the factor of the above equation (1).

First, a method of reducing the light absorption coefficient by adjusting a glass ingredient so as to enhance the transmittance of a panel.

Second, a method of adjusting the ratio of a dot diameter at the center portion of a screen to a dot diameter at the corner portion so as to enhance the transmittance of the screen.

Third, a method of adjusting the ratio of a slot width at the center portion of shadow mask to a slot width at the corner portion so as to enhance the transmittance of the shadow mask.

The contrast characteristics should be considered in the first method of adjusting the transmittance of a panel; the brightness and purity limit characteristics should be considered in the second method of adjusting the transmittance of a screen; and the resolution should be considered in the third method of adjusting the transmittance of a shadow mask.

The transmittances of the panel (Tp), the screen (Ts) and the shadow mask (Tm) are expressed by the following equations (2), (3) and (4), respectively.

$$Tp = (1-R)^2 \times e^{-K \times t}; \quad (2)$$

$$Ts = \frac{S_{dot}}{S_{beam}}; \text{ and} \quad (3)$$

$$Tm = \frac{S_{slot}}{Ph \times Pv} \quad (4)$$

Wherein, R denotes glass reflectance, K denotes light absorption coefficient, S denotes area, Ph denotes horizontal pitch of a slot of the shadow mask, and Pv denotes vertical pitch of a slot of the shadow mask.

Figure 6:
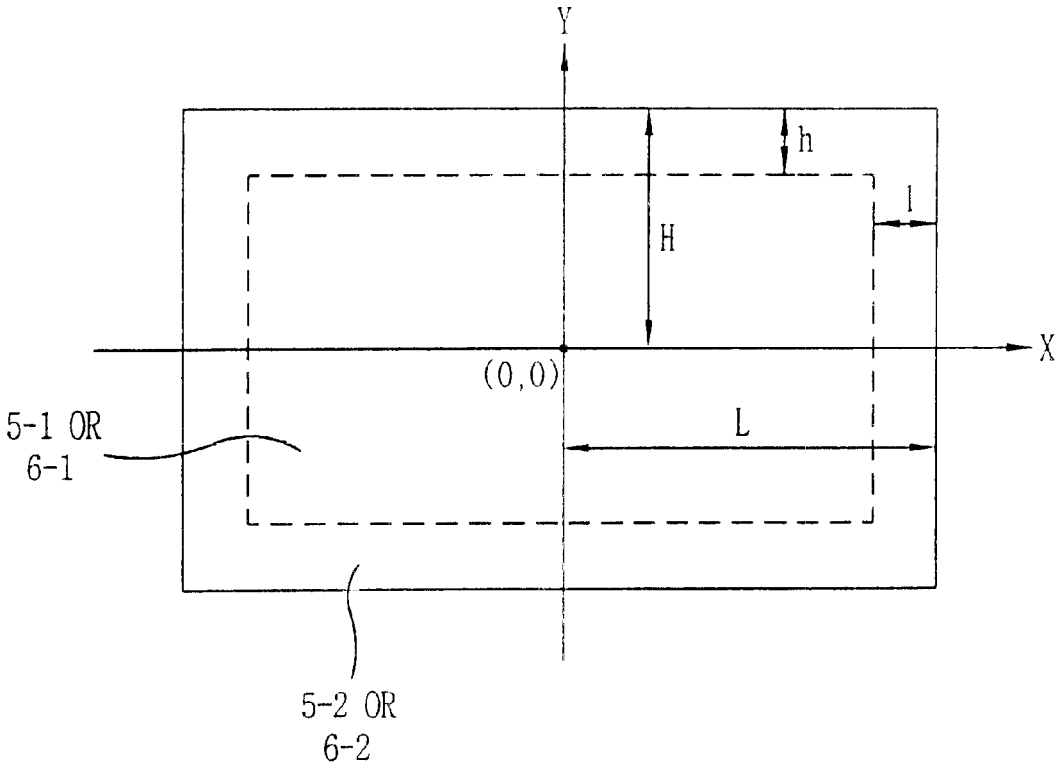
FIG. 6 a diagram showing an effective surface of a screen and a shadow mask according to the present invention.
Figure 8:
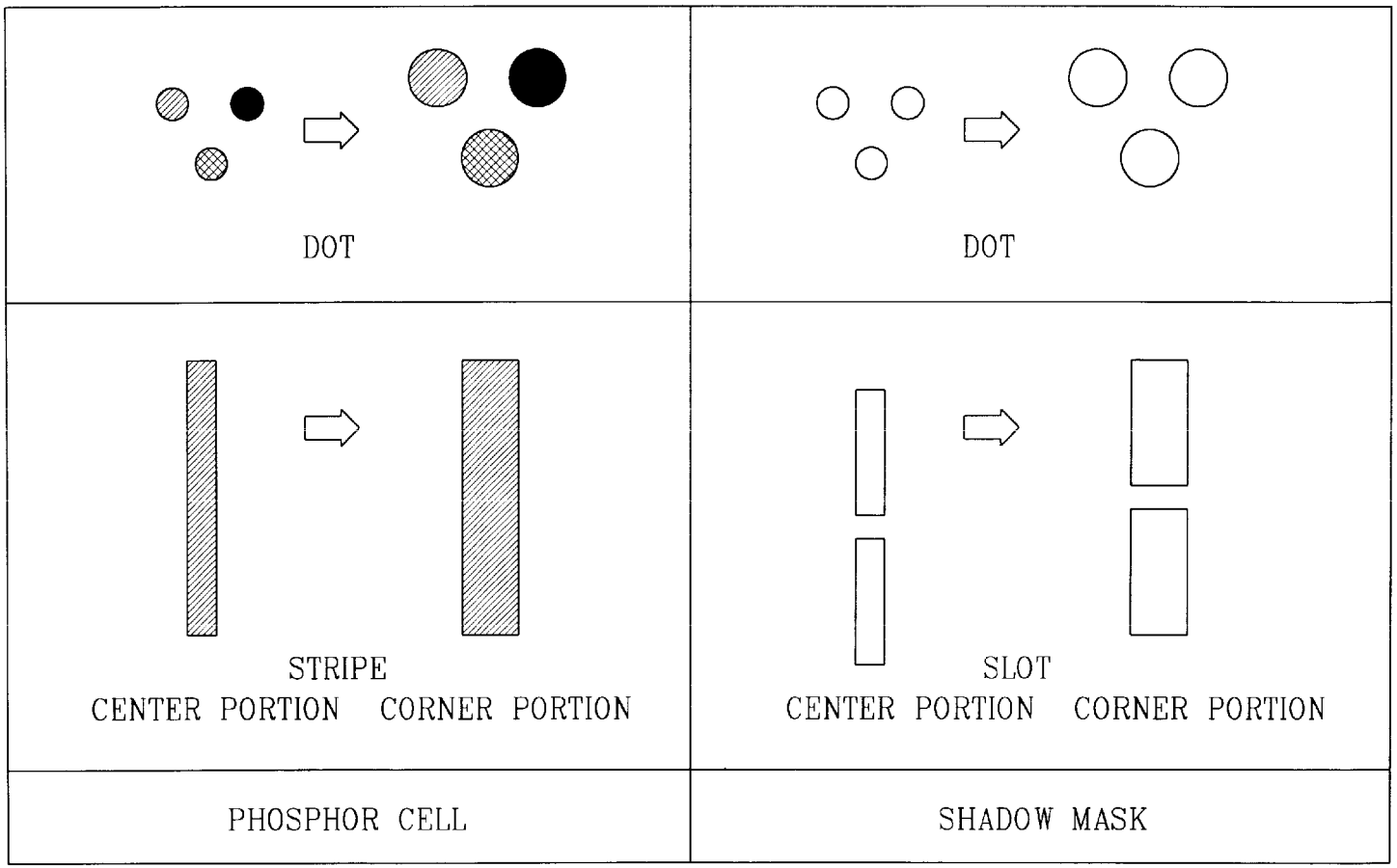
FIG. 8 is a diagram showing the variation in size of the phosphor cells of the screen and the apertures of the shadow mask, respectively, between the center portion and the corner portions, according to the invention.

Accordingly, in an embodiment of the present invention, a basic experiment is carried out in consideration of the contrast characteristics and the brightness and purity limit characteristics described above, thereby obtaining data as represented in Tables 1 through 3b. Here, to obtain the following tables 1 through 3b, the positions of varying the slot widths of the shadow mask and the dot diameters of the screen are described as shown in FIG. 6. FIG. 8 shows the variation in size of the phosphor cells of the screen and the apertures of the shadow mask, respectively, between the center portion and the corner portion, according to the invention.

As shown in FIG. 6, the center portions and corner portions of the screen 5 and the shadow mask 6 are positioned in such a manner that, with respect to the vertical distance(H) or horizontal distance(L) of the effective surface from the central axis(0,0) of the screen 5 or the shadow mask 6, the vertical region of the corner portion is an outer region(h) that is 12~22% the vertical distance(H) and the horizontal region of the corner portion is an outer portion(l) that is 5~15% the horizontal distance(L).

The center portions 5-1 and 6-1 of the screen 5 and the shadow mask 6 are 17% the horizontal distance(H) from the above horizontal region, and the corner portions 5-2 and 6-2 are 10% the vertical distance(L) from the vertical region, which will be described as follows in more detail Half the vertical length of the screen 5 or the shadow mask 6 is defined by the length (H) from the center (O) to the upper corner, and half the horizontal length is defined by the length (L) from the center (O) to the right corner. At this time, the horizontal and vertical positions of the slot width or dot diameter positioned at the corner portion of the screen or shadow mask are defined by L-l and H-h, respectively.

In this embodiment of the present invention, when the vertical length (H) and the horizontal length (L) of the screen 5 are defined by 186.3 mm and 331.2 mm, respectively, h can be set to 32 mm (=0.17 H) and l can be set to 32 mm (0.097 L). In addition, when the vertical length (H) and the horizontal length (L) of the shadow mask 6 corresponding to the screen 5 are defined by 177 mm and 307.8 mm, respectively, h of the shadow mask is set to 29.7 (=0.168 H) and l of the shadow mask is set to 29.7 (=0.096 L).

Therefore, h of the outer region of the screen or the shadow mask becomes 12~22% H, and l of the outer region of the screen or the shadow mask becomes 5~15% L. However, h and l are more preferably set to 0.17 H and 0.1 L, respectively. Tables created by considering the above variables will be described as follows.

Figure 2:
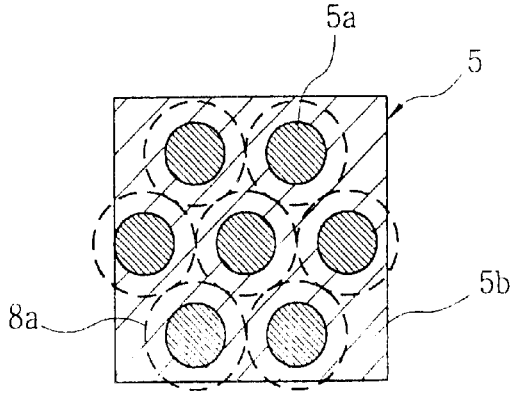
FIG. 2 CONVENTIONAL ART
FIG. 2 is a detailed view showing one portion of a screen of a conventional color cathode ray tube.
Figure 3:
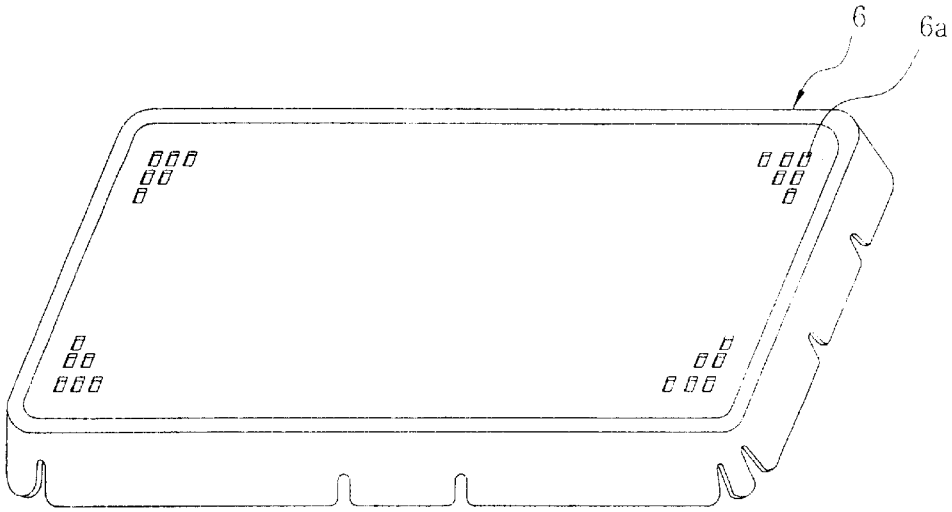
FIG. 3 CONVENTIONAL ART
FIG. 3 is a schematic perspective view of a shadow mask of a conventional color cathode ray tube.
Figure 4A:
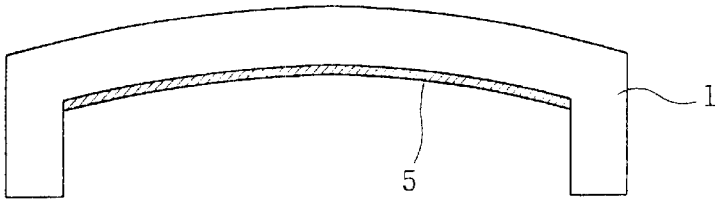
FIG. 4A CONVENTIONAL ART
FIG. 4A is a view showing a conventional panel having outer and inner surfaces curvatures.
Figure 4B:
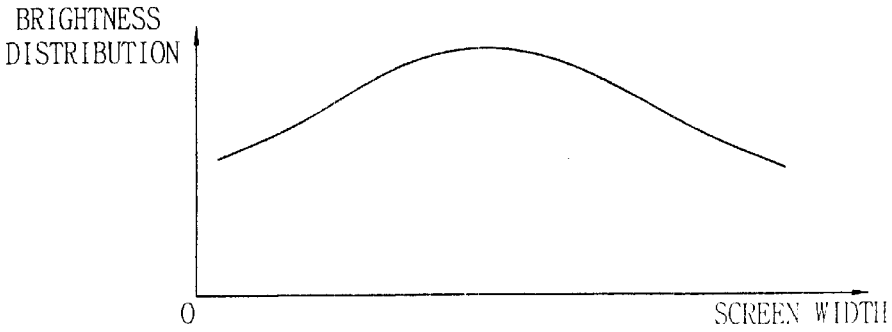
FIG. 4B CONVENTIONAL ART
FIG. 4B is a diagram showing a brightness distribution of a conventional panel.
Figure 5A:
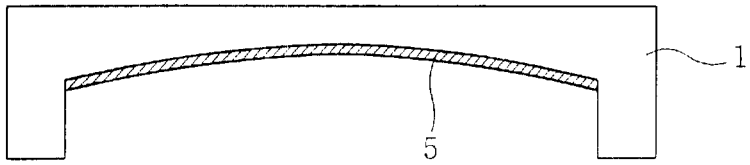
FIG. 5A CONVENTIONAL ART
FIG. 5A is a view showing a conventional panel having a flat outer surface and a curved inner surface.
Figure 5B:
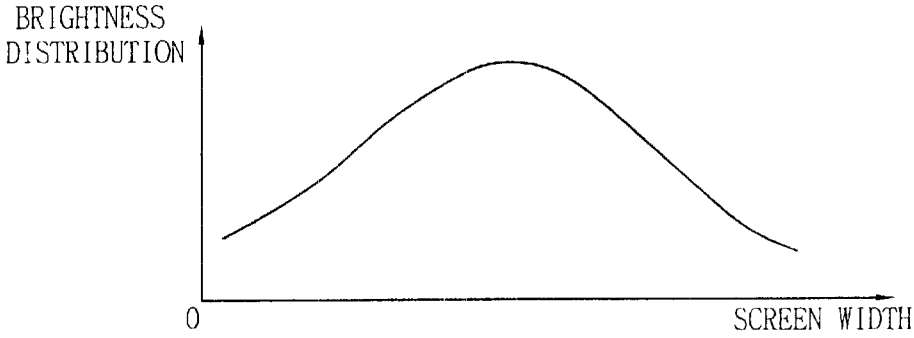
FIG. 5B CONVENTIONAL ART
FIG. 5B is a diagram showing a brightness distribution of the panel of FIG. 5A.

Table 1 explains the bright uniformity according to the change of the light absorption coefficient of a panel, FIG. 2 explains the bright uniformity according to the size of the fluorescent dot diameter of a screen, and FIG. 3 explains the bright uniformity according to the size of the slot width of a shadow mask.

TABLE 1

| | Panel thickness (mm) | Panel transmittance at center portion | Glass reflectance | Light absorption coefficient | Panel transmittance at corner portion | BU(%) |
|---|---|---|---|---|---|---|
| Comparison example | In case, Center = | 35 | 0.045 | 0.06378 | 14 | 41 |
| Embodiment 1 | 14.0 and | 44 | 0.045 | 0.04858 | 22 | 50 |
| Embodiment 2 | Corner = | 47 | 0.045 | 0.04418 | 25 | 54 |
| Embodiment 3 | 2.8, then | 50 | 0.045 | 0.03998 | 29 | 57 |
| Embodiment 4 | wedge | 53 | 0.045 | 0.03668 | 32 | 60 |
| Embodiment 5 | ratio = | 55 | 0.045 | 0.03368 | 34 | 62 |
| Embodiment 6 | 234% | 60 | 0.045 | 0.02788 | 41 | 68 |
| Embodiment 7 | | 65 | 0.045 | 0.02248 | 47 | 73 |
| Embodiment 8 | | 70 | 0.045 | 0.01758 | 55 | 78 |
| Embodiment 9 | | 75 | 0.045 | 0.01298 | 62 | 83 |
| Embodiment 10 | | 77 | 0.045 | 0.01128 | 65 | 85 |

As shown in Table 1, in a panel with a certain wedge ratio, the light absorption coefficient(K) is from 0.04858 (embodiment 1) to 0.01128(embodiment 10), and the bright uniformity is from 50% to 85%.

TABLE 2a

| | Dot diameter at corner portion of Screen(μm) | Screen transmittance at corner portion | Dot diameter at center portion of Screen(μm) | Screen transmittance at center portion | BU(%) | Beam diameter at corner portion |
|---|---|---|---|---|---|---|
| Embodiment 1 | 158 | 49.1 | 150 | 60.7 | 50 | 322 |
| Embodiment 2 | 170 | 52.8 | | | 56 | |
| Embodiment 3 | 180 | 55.9 | | | 59 | |
| Embodiment 4 | 185 | 57.5 | | | 61 | |
| Embodiment 5 | 190 | 59.0 | | | 62 | |
| Embodiment 6 | 200 | 62.0 | | | 66 | |

As shown in Table 2a, when the center portion of the screen has a certain fluorescent dot diameter and a certain stripe width, the fluorescent dot diameter and the stripe width of the corner portion of the screen is from 158 μm (embodiment 1) to 200 μm (embodiment 6), and accordingly the bright uniformity becomes more than 50%.

TABLE 2b

| | Dot diameter at center portion of Screen(μm) | Screen transmittance at center portion | Dot diameter at corner portion of Screen(μm) | Screen transmittance at corner portion | BU(%) | Beam diameter at center portion |
|---|---|---|---|---|---|---|
| Embodiment 1 | 160 | 64.7 | 160 | 49.7 | 50 | 247 |
| Embodiment 2 | 150 | 60.7 | | | 57 | |
| Embodiment 3 | 140 | 56.7 | | | 59 | |
| Embodiment 4 | 130 | 52.6 | | | 60 | |
| Embodiment 5 | 120 | 48.6 | | | 62 | |
| Embodiment 6 | 110 | 44.5 | | | 64 | |

As shown in Table 2b, when the corner portion of the screen has a certain fluorescent dot diameter and a certain stripe width, the fluorescent dot diameter and the stripe width of the center portion of the screen is from 160 μm (embodiment 1) to 110 μm (embodiment 6), and accordingly the bright uniformity becomes more than 50%.

TABLE 3a

| | Slot diameter at corner portion of shadow mask(μm) | Shadow mask transmittance at corner portion | Slot diameter at center portion of shadow mask(μm) | Shadow mask transmittance at center portion | BU(%) | Shadow mask pitch at corner portion |
|---|---|---|---|---|---|---|
| Embodiment 1 | 190 | 15.3 | 180 | 20.6 | 50 | Ph = 840 |
| Embodiment 2 | 220 | 17.4 | | | 57 | Pv = 590 |
| Embodiment 3 | 230 | 18.1 | | | 59 | |
| Embodiment 4 | 235 | 18.5 | | | 60 | |
| Embodiment 5 | 240 | 18.8 | | | 62 | |
| Embodiment 6 | 250 | 19.5 | | | 66 | |

As shown in Table 3a, when the center portion of the shadow mask has a certain fluorescent dot diameter and a certain stripe width, the fluorescent dot diameter and the stripe width of the corner portion of the shadow mask is from 190 μm (embodiment 1) to 250 μm (embodiment 6), and accordingly the bright uniformity becomes more than 50%.

However, when the dot diameter at the corner portion is increased too much, the purity limit is reduced, and the yield rate in the coating process, one of the fabrication processes, is reduced as well, resulting in a bad effect on productivity. Thus, it is appropriate to increase the dot diameter at the corner portion by about 100~127% compared to the dot diameter at the center portion.

TABLE 3b

| | Slot diameter at center portion of shadow mask (μm) | Shadow mask transmittance at center portion | Slot diameter at corner portion of shadow mask (μm) | Shadow mask transmittance at corner portion | BU(%) | Shadow mask pitch at center portion |
|---|---|---|---|---|---|---|
| Embodiment 1 | 189 | 21.9 | 200 | 16.0 | 50 | Ph = 640 |
| Embodiment 2 | 170 | 19.0 | | | 57 | Pv = 590 |
| Embodiment 3 | 160 | 18.5 | | | 58 | |
| Embodiment 4 | 155 | 17.9 | | | 60 | |
| Embodiment 5 | 150 | 17.4 | | | 62 | |
| Embodiment 6 | 140 | 16.3 | | | 66 | |

As shown in Table 3b, when the corner portion of the shadow mask has a certain fluorescent dot diameter and a certain stripe width, the fluorescent dot diameter and the stripe width of the center portion of the shadow mask is from 189 μm (embodiment 1) to 140 μm (embodiment 6), and accordingly the bright uniformity becomes more than 50%.

When the above experiment results are applied to a shadow mask type color cathode ray tube, more than 50% BU characteristics are obtained even if the panel's wedge ratio is more than 170%.

In order to design a color cathode ray tube with a different wedge ratio by changing the wedge ratio of a panel of a color cathode ray tube which is more than 170%, one or more of the light absorption coefficient of the panel, the ratio of the dot diameter at the corner portion to the dot diameter at the center portion of the screen, and the ratio of the slot width at the corner portion to the slot width at the center portion of the shadow mask must be changed according to the experiment results shown in Tables 1 through 3b, thereby designing a panel, a screen or a shadow mask according to the present invention.

The light absorption coefficient of the panel is preferably set to less than 0.04858 as shown in Table 1. However, the smaller the light absorption coefficient, the higher the price of the glass used for the panel, the weight is heavier, and the contrast characteristics are worse. Therefore, it is appropriate that the light absorption coefficient of the panel be set between 0.04858 and 0.01758.

In addition, it is desirable to increase the dot diameter at the corner portion of the screen by more than 100% compared to the dot diameter at the center portion in order to enhance the screen's transmittance as shown in Table 2b.

Furthermore, it is desirable to increase the slot width at the corner portion of the shadow mask by more than 105% compared to the slot width at the center portion with respect to the slot width of a shadow mask in order to enhance the shadow mask's transmittance as shown in Table 3a. However, when the slot width at the corner portion is increased too much, the purity limit is reduced. Thus, considering that, it is appropriate to increase the slot width at the corner portion by about 105–133% compared to the slot width at the center portion.

Figure 7A:
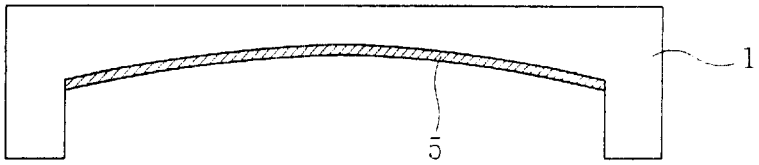
FIG. 7A is a view showing a panel having a flat outer surface and a curved inner surface according to the present invention.
Figure 7B:
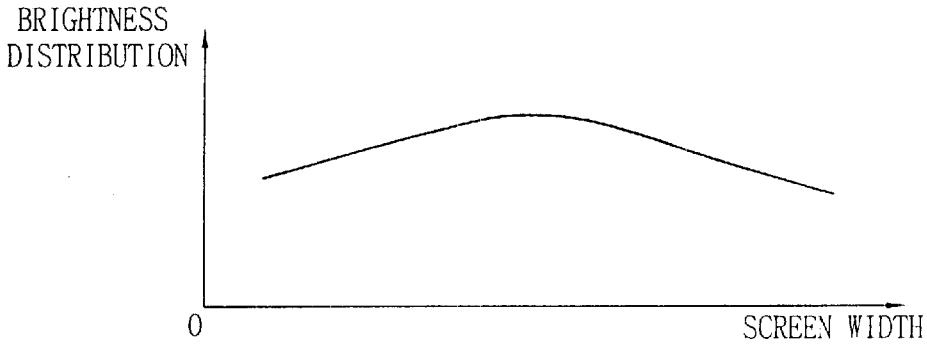
FIG. 7B a diagram showing a brightness distribution of the panel according to the present invention.
Figure 7C:
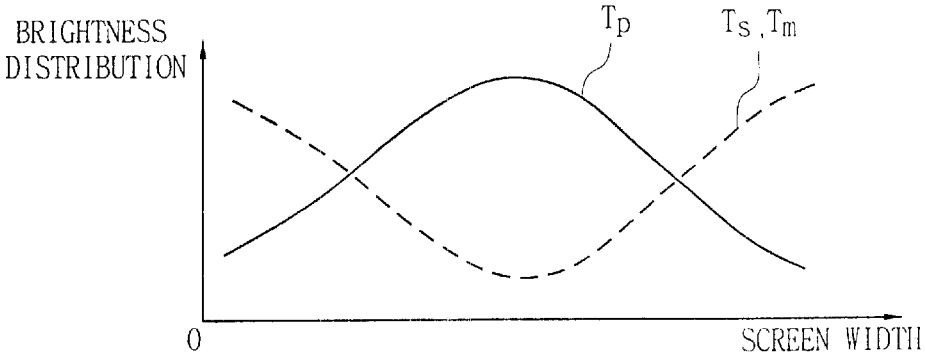
FIG. 7C a diagram showing a transmittance of a panel according to the present invention.

Accordingly, a color cathode ray tube according to the present invention has a distribution of transmittances of a panel, a screen, and a shadow mask as shown in FIG. 7C although the panel has a curved inner surface and a flattened outer surface as shown in FIG. 7A. Thus, the brightness has a distribution as shown in FIG. 7B.

As described above, in an embodiment according to the present invention, although the panel's wedge ratio is more than 170%, better B/U characteristics are assured, and a tint glass can be used in fabricating a panel in place of a clear glass, thereby reducing the cost and weight of a color cathode ray tube compared to the conventional art.

What is claimed is:

1. In a color cathode ray tube comprising a panel with a wedge ratio of more than 170%, a screen onto which electron beams are scanned and on which are formed phosphor cells having a certain width coating with RGB phosphors and a black matrix layer comprising a black coating material formed on all the areas of the screen except for the areas containing phosphor cells, and a shadow mask on which a plurality of apertures are arranged corresponding to the phosphor cells, an improvement comprising:

the screen in which the width of the phosphor cells at the corner portions is larger than the width of the phosphor cells at the center portion by about 100–127%, and the shadow mask in which the width of the apertures at the corner portions is larger than the width of the apertures at the center portion by about 105–133%.

2. The color cathode ray tube of claim 1, wherein the panel has a light absorption coefficient varied from 0.04858 to 0.01758.

3. The color cathode ray tube of claim 1, wherein the width of the phosphor cells at the corner portions of the screen is about 110–127% larger than the width of the phosphor cells at the center portion, and the width of the apertures at the corner portions of the shadow mask is about 115–133% larger than the width of the apertures at the center portion.

4. The color cathode ray tube of claim 1, wherein the corner portions of the screen or shadow mask are regions between portion h positioned inside and is 12~22% the vertical distance H of the screen or shadow mask, and portion I positioned inside and is 5~15% the horizontal distance L.

5. The color cathode ray tube of claim 1, wherein the phosphor cells are in the shape of a stripe or dot.

6. The color cathode ray tube of claim 5, wherein the width of the phosphor cells at the corner portions of the screen is 100–127% larger than the width of the phosphor cells at the center portion, and the width of the shadow mask apertures at the corner portion of the shadow mask is 105–133% larger than the width of the shadow mask apertures at the center portion.

7. The color cathode ray tube of claim 1, wherein the shadow mask apertures are in the shape of a slot or dot.

8. The color cathode ray tube of claim 7, wherein the width of the phosphor cells at the corner portions of the screen is 100–127% larger than the width of the phosphor cells at the center portion, and the width of the shadow mask apertures at the corner portions of the shadow mask is 105–133% larger than the width of the shadow mask apertures at the center portion.

9. The color cathode ray tube of claim 1, wherein the width of the phosphor cells at the corner portions of the screen is 100–127% larger than the width of the phosphor cells at the center portion, and the width of the shadow mask apertures at the corner portions of the shadow mask is 105–133% larger than the width of the shadow mask apertures of the center portion.

* * * * *